US008364385B2

(12) United States Patent
Buslepp et al.

(10) Patent No.: US 8,364,385 B2
(45) Date of Patent: Jan. 29, 2013

(54) CYLINDER PRESSURE SENSOR RESET SYSTEMS AND METHODS

(75) Inventors: Kenneth J. Buslepp, Brighton, MI (US); Douglas R. Verner, Sterling Heights, MI (US); Joseph R. Dulzo, Novi, MI (US)

(73) Assignee: GM Global Technology Operations LLC

( * ) Notice: Subject to any disclaimer, the term of this patent is extended or adjusted under 35 U.S.C. 154(b) by 394 days.

(21) Appl. No.: 12/749,825

(22) Filed: Mar. 30, 2010

(65) Prior Publication Data

US 2011/0246044 A1 Oct. 6, 2011

(51) Int. Cl.
*F02D 43/00* (2006.01)

(52) U.S. Cl. ..... 701/107; 701/111; 123/435

(58) Field of Classification Search ..... 123/435; 701/107, 111; 73/35.12, 114.16, 114.17, 73/114.18

See application file for complete search history.

(56) References Cited

U.S. PATENT DOCUMENTS

| | | | | |
|---|---|---|---|---|
| 7,062,955 | B2 * | 6/2006 | Kashiwase et al. | 73/114.16 |
| 7,212,912 | B2 * | 5/2007 | Okubo et a | 701/114 |
| 7,255,090 | B2 * | 8/2007 | Fader et al. | 123/435 |
| 7,467,041 | B2 * | 12/2008 | Okubo et al. | 701/103 |
| 7,757,545 | B2 * | 7/2010 | Sato et al. | 73/114.16 |
| 7,840,362 | B2 * | 11/2010 | Mayrhofer et al. | 702/34 |
| 7,894,977 | B2 * | 2/2011 | Bauer et al. | 701/114 |
| 7,905,206 | B2 * | 3/2011 | Willi et al. | 123/90.15 |
| 7,905,214 | B2 * | 3/2011 | Bauer et al. | 123/435 |
| 7,930,093 | B2 * | 4/2011 | Bauer et al. | 701/114 |

* cited by examiner

*Primary Examiner* — Hai Huynh

(57) ABSTRACT

A system for a vehicle includes a cylinder pressure sensor and a control module. The cylinder pressure sensor measures pressure within a cylinder of an engine, generates increases in a cylinder pressure signal based on the pressure, selectively generates a predetermined profile in the cylinder pressure signal, and selectively resets the cylinder pressure signal to a predetermined reset level after generating the predetermined profile in the cylinder pressure signal. The control module receives the cylinder pressure signal, detects the predetermined profile of the cylinder pressure signal, and detects the resetting of the cylinder pressure signal to the predetermined reset level when the predetermined profile is detected.

17 Claims, 5 Drawing Sheets

CYLINDER PRESSURE SENSOR RESET SYSTEMS AND METHODS

FIELD

The present disclosure relates to internal combustion engines and more particularly to cylinder pressure sensors.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Combustion of an air/fuel mixture within a cylinder of an engine generates torque. A cylinder pressure sensor associated with the cylinder measures pressure within the cylinder. The cylinder pressure sensor generates a cylinder pressure signal based on the cylinder pressure. For example only, the cylinder pressure signal may include a voltage signal. The cylinder pressure sensor may transmit the cylinder pressure signal to a control module (e.g., an engine control module) via a first electrical conductor (e.g., wire).

The cylinder pressure sensor generates the cylinder pressure signal relative to a reference level. The reference level refers to the cylinder pressure signal from which the cylinder pressure signal increases as the cylinder pressure increases during combustion within the cylinder. Over time, however, operation of the cylinder pressure sensor causes the reference level to approach an upper limit of a predetermined range of the cylinder pressure signal. For example only, a filter/amplifier of the cylinder pressure sensor may wind up over time and cause the reference level to approach the upper limit.

The cylinder pressure signal may be clipped by the upper limit when the reference level approaches the upper limit. For example only, the cylinder pressure signal may be clipped by the upper limit when a difference between the reference level and the upper limit is less than a change in the cylinder pressure signal necessary to reflect a measured cylinder pressure increase. If the reference level reaches the upper limit, the cylinder pressure signal may be maintained at the upper limit.

Accordingly, the cylinder pressure signal (and therefore the reference level) is reset to a predetermined reset level from time to time. The cylinder pressure signal may be reset to the predetermined reset level by reducing an impedance at an input to the cylinder pressure sensor to effectively short circuit the output of the cylinder pressure sensor. A second electrical conductor may be used to coordinate the resetting between the cylinder pressure sensor and the control module. For example, the control module may transmit a reset signal to the cylinder pressure sensor via the second electrical wire to instruct the cylinder pressure sensor to reset the cylinder pressure signal to the predetermined reset level. For another example, the cylinder pressure sensor may transmit a reset signal to the control module via the second electrical wire to notify the control module that the cylinder pressure sensor is resetting the cylinder pressure signal to the predetermined reset level.

SUMMARY

A system for a vehicle includes a cylinder pressure sensor and a control module. The cylinder pressure sensor measures pressure within a cylinder of an engine, generates increases in a cylinder pressure signal based on the pressure, selectively generates a predetermined profile in the cylinder pressure signal, and selectively resets the cylinder pressure signal to a predetermined reset level after generating the predetermined profile in the cylinder pressure signal. The control module receives the cylinder pressure signal, detects the predetermined profile of the cylinder pressure signal, and detects the resetting of the cylinder pressure signal to the predetermined reset level when the predetermined profile is detected.

A cylinder pressure sensor for a vehicle includes a sensing element, a reset module, and a signal generation module. The sensing element measures pressure within a cylinder of an engine. The reset module selectively generates a reset signal. The signal generation module generates a cylinder pressure signal based on the pressure, generates a predetermined profile in the cylinder pressure signal when the reset signal is generated, and sets the cylinder pressure signal to a predetermined reset level after generating the predetermined profile.

A control module for a vehicle includes a parameter determination module and a reset detection module. The parameter determination module receives a cylinder pressure signal from a cylinder pressure sensor associated with and measuring pressure within a cylinder of an engine and selectively determines a parameter based on the cylinder pressure signal. The reset detection module detects a reset event of the cylinder pressure signal when the cylinder pressure signal includes a predetermined profile before reaching a predetermined reset level.

A method includes: measuring pressure within a cylinder of an engine; generating increases in a cylinder pressure signal based on the pressure; selectively generating a predetermined profile in the cylinder pressure signal; selectively resetting the cylinder pressure signal to a predetermined reset level after generating the predetermined profile in the cylinder pressure signal; detecting the predetermined profile of the cylinder pressure signal; and detecting the resetting of the cylinder pressure signal to the predetermined reset level when the predetermined profile is detected.

In other implementations, a method includes: measuring pressure within a cylinder of an engine; selectively generating a reset signal; generating a cylinder pressure signal based on the pressure; generating a predetermined profile in the cylinder pressure signal when the reset signal is generated; and setting the cylinder pressure signal to a predetermined reset level after generating the predetermined profile.

In still other implementations, a method includes: receiving a cylinder pressure signal from a cylinder pressure sensor associated with and measuring pressure within a cylinder of an engine; selectively determining a parameter based on the cylinder pressure signal; and detecting a reset event of the cylinder pressure signal when the cylinder pressure signal includes a predetermined profile before reaching a predetermined reset level.

In still other features, the systems and methods described above are implemented by a computer program executed by one or more processors. The computer program can reside on a tangible computer readable medium such as but not limited to memory, nonvolatile data storage, and/or other suitable tangible storage mediums.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
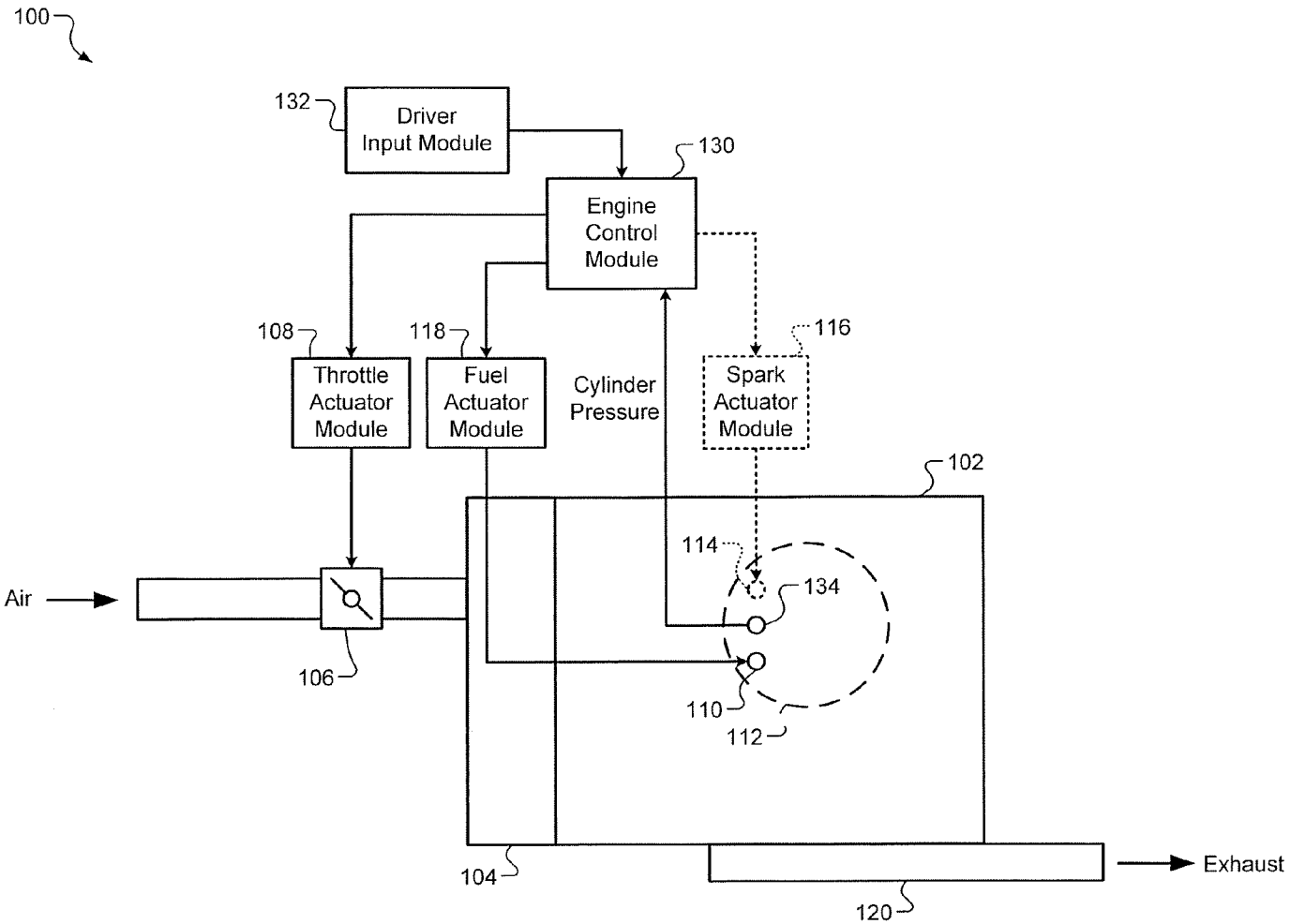
FIG. 1 is a functional block diagram of an exemplary engine system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

A cylinder pressure sensor measures pressure within a cylinder of an engine and generates a cylinder pressure signal based on the cylinder pressure. The cylinder pressure sensor generates increases in the cylinder pressure signal (each corresponding to a combustion event) relative to a reference level. Over time, the reference level of the cylinder pressure signal may drift toward a limit (e.g., upper or lower) of a predetermined range of the cylinder pressure signal.

The cylinder pressure signal may be clipped by the limit when a magnitude of the drift becomes large. For example only, the cylinder pressure signal may be clipped by an upper limit when a difference between the reference level and the upper limit is less than a change in the cylinder pressure signal necessary to reflect a cylinder pressure increase. If the reference level reaches the upper limit, the cylinder pressure signal may be maintained at the upper limit.

The cylinder pressure sensor communicates the cylinder pressure signal to a control module via an electrical conductor (e.g., wire). The cylinder pressure sensor selectively resets the cylinder pressure signal to a predetermined reset level. For example only, the cylinder pressure sensor may reset the cylinder pressure signal to the predetermined reset level to prevent the cylinder pressure signal from being clipped by and limited to the limit.

The cylinder pressure sensor of the present disclosure notifies the control module when the cylinder pressure signal will be reset via the electrical wire. More specifically, the cylinder pressure sensor notifies the control module that the cylinder pressure signal will be reset to the predetermined reset level by generating a predetermined profile in the cylinder pressure signal, despite the cylinder pressure.

The control module may detect the predetermined profile in the cylinder pressure signal and determine that the cylinder pressure signal is being reset when the predetermined profile is detected. The control module may then correct to account for the reset, disable one or more functions performed based on the cylinder pressure signal, or take one or more other actions. For example only, the control module may disable diagnosing one or more faults based on the cylinder pressure signal, controlling one or more engine operating parameters based on the cylinder pressure signal, and determining one or more parameters based on the cylinder pressure signal.

By notifying the control module of the resetting via the cylinder pressure signal, an electrical wire on which reset signals are communicated between the cylinder pressure sensor and the control module is unnecessary. In implementations where the cylinder pressure sensor resets the cylinder pressure signal by reducing input impedance, the instructions associated with the resetting may be eliminated. In this manner, the cylinder pressure sensor of the present disclosure may reduce the number of wires, may reduce implementation/wiring complexity, may reduce vehicle cost, may reduce the cost of the cylinder pressure sensor, and may provide other benefits.

Referring now to FIG. 1, a functional block diagram of an exemplary engine system 100 is presented. Air is drawn into an engine 102 through an intake manifold 104. A throttle valve 106 controls airflow into the engine 102. A throttle actuator module 108 controls opening of the throttle valve 106. The throttle actuator module 108 therefore controls airflow into the engine 102. The air mixes with fuel from one or more fuel injectors, such as fuel injector 110, to form an air/fuel mixture.

The air/fuel mixture is combusted within one or more cylinders of the engine 102, such as cylinder 112. Combustion of the air/fuel mixture may be initiated by, for example, injection of the fuel or spark provided by a spark plug 114. In spark ignition engine systems, a spark actuator module 116 controls the spark plug 114. A fuel actuator module 118 controls the fuel injector 110. Combustion of the air/fuel mixture produces torque and exhaust gas.

Torque is generated via heat release and expansion during combustion of the air/fuel mixture within the cylinder 112. Torque is transferred by a crankshaft to a driveline, which transfers torque to one or more wheels to propel a vehicle (not shown). The exhaust is expelled from the engine 102 to an exhaust system 120.

An engine control module (ECM) 130 controls the torque output of the engine 102. The ECM 130 may control the torque output of the engine 102 by controlling one or more engine actuators, such as the throttle actuator module 108, the fuel actuator module 118, and the spark actuator module 116. The ECM 130 may control the torque output of the engine 102 based on driver inputs and/or other inputs.

A driver input module 132 provides the driver inputs to the ECM 130. The driver inputs may include, for example, an accelerator pedal position, a brake pedal position, and other suitable driver inputs. The other inputs may include a cylinder pressure signal provided by a cylinder pressure sensor 134 and other suitable inputs.

The cylinder pressure sensor 134 measures pressure within the cylinder 112. The cylinder pressure sensor 134 generates the cylinder pressure signal based on the cylinder pressure. While independently shown in the exemplary embodiment of FIG. 1, the cylinder pressure sensor 134 may be implemented with another component associated with the cylinder 112, such as the fuel injector 110 or the spark plug 114.

For example only, the cylinder pressure signal may be a voltage, and the voltage may increase as the cylinder pressure increases. The cylinder pressure sensor 134 may generate the cylinder pressure signal within a predetermined range. For example only, the predetermined operating range may be between a lower limit of approximately 0.0 V and an upper limit of approximately 5.0 V. The cylinder pressure sensor 134 may be in a short circuit (fault) state when the cylinder pressure signal is equal to the lower limit (e.g., 0.0 V), and the cylinder pressure sensor 134 may be in an open circuit (fault) state when the cylinder pressure signal is equal to the upper limit (e.g., 5.0 V).

The ECM 130 may determine one or more parameters based on the cylinder pressure signal. For example only, the ECM 130 may determine a pressure ratio for a cylinder at a plurality of crankshaft angles. The pressure ratio at a given crankshaft angle may correspond to a ratio of the cylinder pressure at the crankshaft angle to a motored (ideal) cylinder pressure at the crankshaft angle if combustion did not occur within the cylinder 112. In other words, the motored cylinder pressure may correspond to an estimated cylinder pressure at the crankshaft angle when the engine 102 is being motored. Other parameters that the ECM 130 may determine based on the cylinder pressure signal may include, for example, the cylinder pressure (e.g., kPa) corresponding to the cylinder pressure signal, a crankshaft angle at which a predetermined percentage of fuel was combusted, a heat release rate, indicated mean effective pressure (IMEP), a cylinder ringing value, a peak pressure experienced during an engine cycle, a crankshaft angle where the peak pressure occurred, a knock value, and one or more other suitable parameters.

The predetermined percentage may be 10 percent, 50 percent, 90 percent, and/or another suitable percentage. The crankshaft angle (CA) at which the predetermined percentage of fuel was combusted may be referred to as CA##, where ## is the predetermined percentage. For example only, CA10 refers to the crankshaft angle at which 10 percent of the fuel was combusted, CA50 refers to the crankshaft angle at which 50 percent of the fuel was combusted, and CA90 refers to the crankshaft angle at which 90 percent of the fuel was combusted.

The ECM 130 may adjust one or more engine operating parameters based on the cylinder pressure signal and/or one or more of the determined parameters, such as combustion timing. The combustion timing may be adjusted in a gasoline engine system via the spark timing, and the combustion timing may be adjusted in a diesel engine system via the fuel injection timing. The ECM 130 may also adjust other engine operating parameters based on the cylinder pressure signal and/or one or more of the determined parameters, such as the amount of fuel injected. The ECM 130 may also diagnose one or more faults based on the cylinder pressure signal and/or one or more of the determined parameters.

However, the cylinder pressure sensor 134 is a relative pressure sensor. In other words, the cylinder pressure sensor 134 measures the cylinder pressure and generates increases in the cylinder pressure signal relative to a reference level. The reference level refers to the cylinder pressure signal from which the cylinder pressure signal increases as the cylinder pressure increases during a combustion event within the cylinder 112. Over time, the reference level drifts, such as toward the upper or lower limit.

The cylinder pressure signal may be meaningless or incomplete when the reference level is near one of the limits of the predetermined range of the cylinder pressure signal. For example only, the cylinder pressure signal may be clipped and limited to the upper limit when, relative to the reference level, the cylinder pressure signal would otherwise increase above the upper limit to reflect a cylinder pressure increase. If the reference level reaches the upper limit, the cylinder pressure signal may remain at the upper limit, even during cylinder pressure increases.

Accordingly, the cylinder pressure sensor 134 selectively resets the cylinder pressure signal to a predetermined reset level. Resetting the cylinder pressure signal to the predetermined reset level means that the reference level is also reset to the predetermined reset level. The predetermined reset level may be near the lower limit of the predetermined range of the cylinder pressure signal. For example only, the predetermined reset level may be approximately 0.7 V. The predetermined reset level being near the lower limit may allow a maximum period between resets.

The cylinder pressure sensor 134 determines when to reset the cylinder pressure signal to the predetermined reset level. The cylinder pressure sensor 134 of the present disclosure generates a predetermined profile in the cylinder pressure signal to notify the ECM 130 that the cylinder pressure signal will be reset to the predetermined reset level.

The ECM 130 detects the predetermined profile in the cylinder pressure signal and determines that the cylinder pressure sensor 134 reset the cylinder pressure signal when the predetermined profile is detected. The ECM 130 may compensate for the resetting or may disable use of the cylinder pressure signal and/or the determination of one or more of the parameters based on the cylinder pressure signal when the predetermined profile is detected. If the cylinder pressure signal having the predetermined profile was used or if the cylinder pressure signal having the predetermined profile was used in determining one or more of the parameters, the ECM 130 may diagnose the presence of one or more faults.

Accordingly, notifying the ECM 130 of the resetting enables the ECM 130 to avoid diagnosing a fault when the reference level is reset and when a fault may not necessarily be present. Further, by notifying the ECM 130 of the resetting via the cylinder pressure signal, the number of electrical wires associated with the cylinder pressure sensor 134 may be reduced by one. The one less wire may be the wire that would otherwise be used to instruct the cylinder pressure sensor 134 to reset the cylinder pressure signal or to notify the ECM 130 of a resetting. Reducing the number of wires associated with the cylinder pressure sensor 134 reduces implementation/wiring complexity, reduces vehicle cost, reduces the cost of the cylinder pressure sensor 134, and may provide other benefits.

Figure 2:
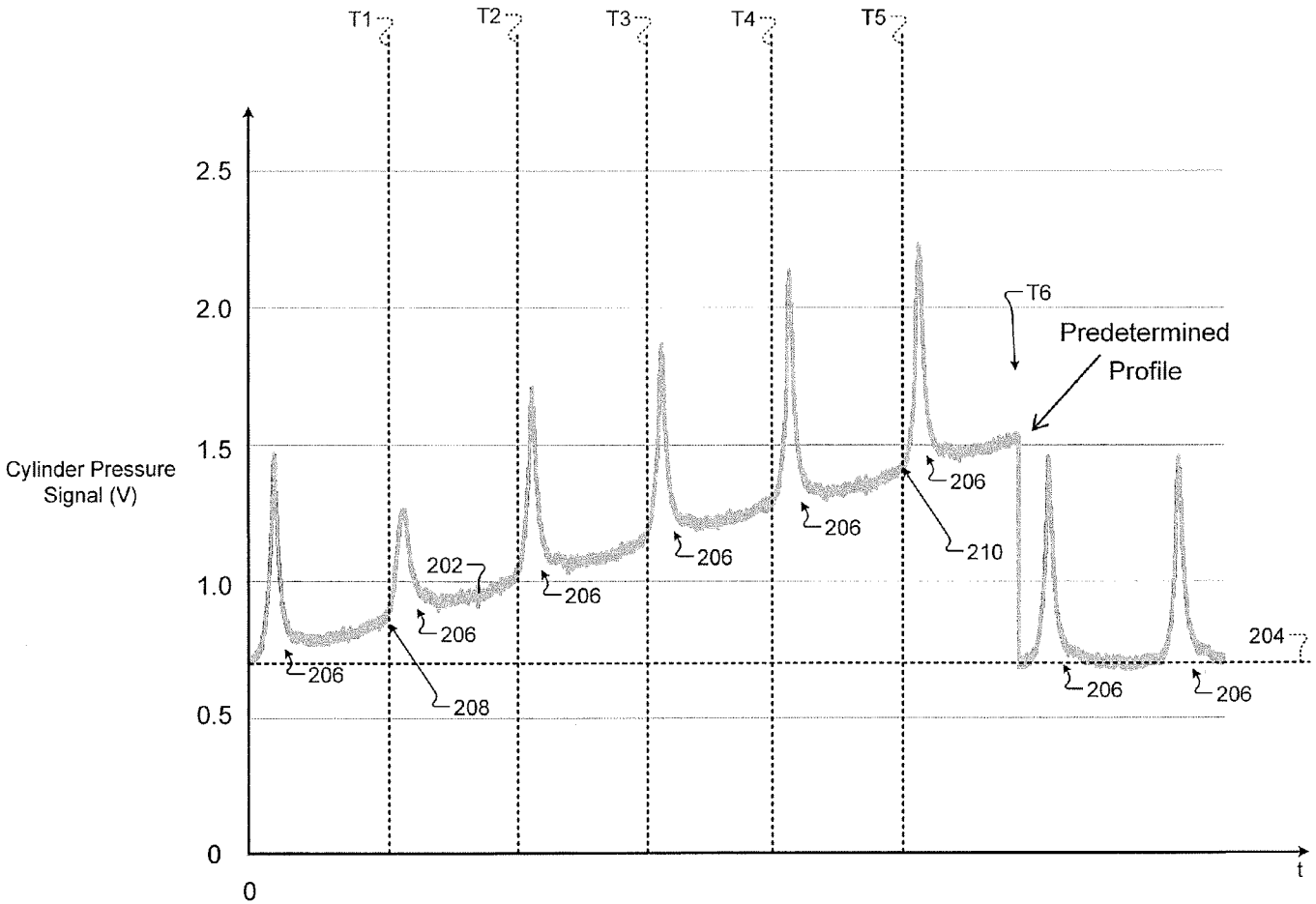
FIGS. 2-3 are exemplary graphs of a cylinder pressure signal as a function of time according to the principles of the present disclosure.
Figure 3:
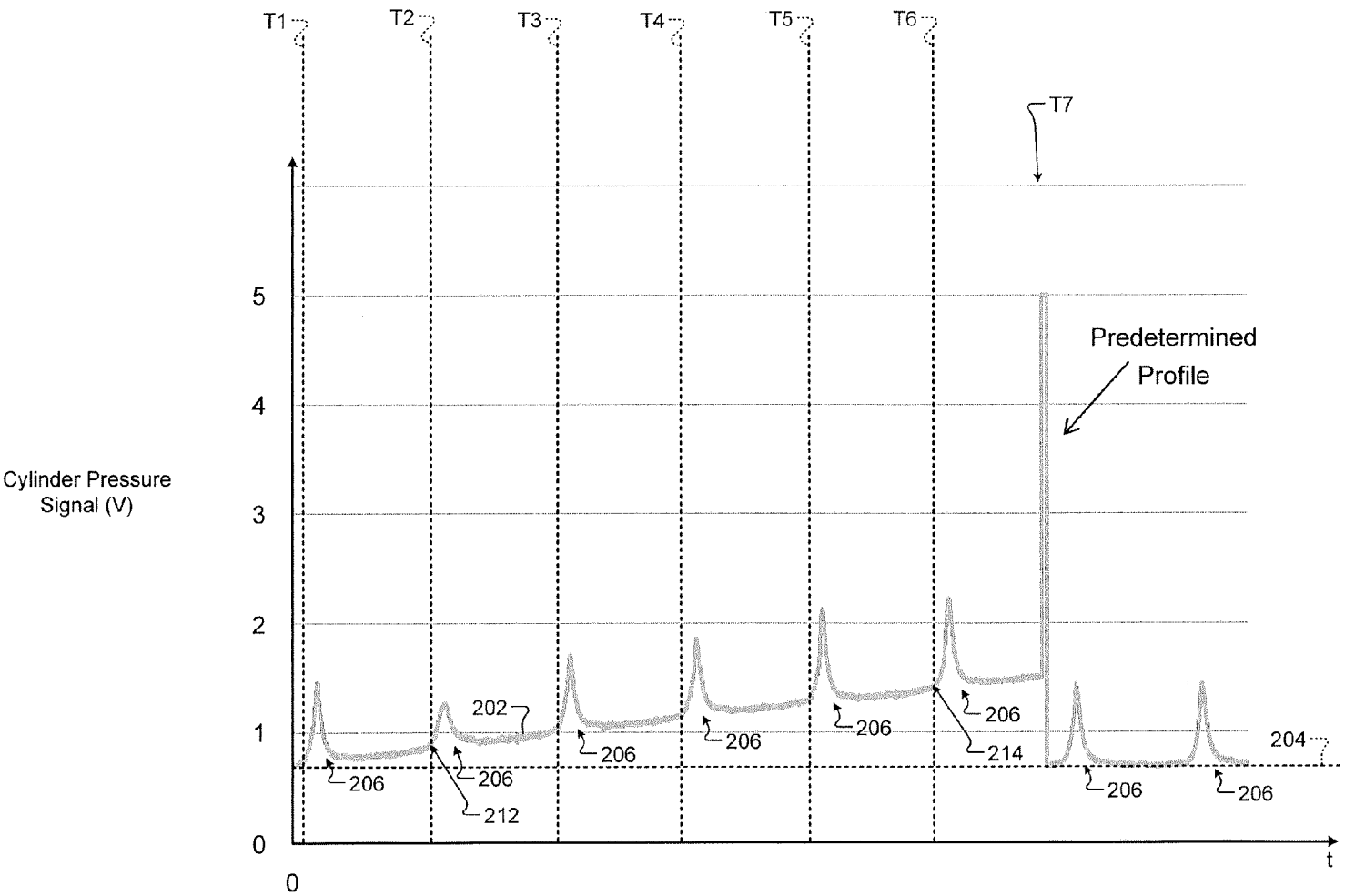

Referring now to FIGS. 2-3, exemplary graphs of the cylinder pressure signal versus time are presented. Exemplary trace 202 tracks the cylinder pressure signal generated by the cylinder pressure sensor 134. Dashed trace 204 is an exemplary predetermined reset level. For example only, the predetermined reset level 204 may be approximately 0.7 V.

Time zero may correspond to a time when the cylinder pressure signal is reset to the predetermined reset level, such as vehicle startup (e.g., key ON). Accordingly, the reference level, relative to which the cylinder pressure sensor 134 generates increases in the cylinder pressure signal 202, is approximately equal to the predetermined reset level 204 at time zero.

Over time, however, as shown in FIGS. 2 and 3, the reference level increases. In the example of FIG. 2, the reference level increases from approximately 0.85 V at time T1, as shown by 208, to approximately 1.4 V at time T4, as shown by 210. In the example of FIG. 3, the reference level increases from approximately 0.8V at time T1, as shown by 212, to approximately 1.4 V at time T6, as shown by 214.

The cylinder pressure sensor 134 selectively resets the cylinder pressure signal 202 to the predetermined reset level 204. For example, the cylinder pressure sensor 134 resets the cylinder pressure signal 202 to the predetermined reset level 204 at approximately exemplary time T6 in the example of FIG. 2 and at approximately exemplary time T7 in the example of FIG. 3.

The cylinder pressure sensor 134 notifies the ECM 130 of a resetting of the cylinder pressure signal 202 by generating a predetermined profile in the cylinder pressure signal 202 that will be recognized by the ECM 130 and distinguished from a combustion event. For example only, the cylinder pressure sensor 134 may notify the ECM 130 by decreasing the cylinder pressure signal 202 by at least a predetermined amount as shown in FIG. 2.

The predetermined amount may be calibratable and may be set to more than a greatest decrease in the cylinder pressure signal 202 that is possible (e.g., greater than a decrease experienced during a worst possible engine misfire, etc.). For example only, the predetermined amount may be approximately 0.75 V (corresponding to a decrease of approximately 2700-2800 kPa) in gasoline engines and approximately 1.0 V (corresponding to a decrease of approximately 3800 kPa) in diesel engine systems. The cylinder pressure sensor 134 may decrease the cylinder pressure signal 202 by the predetermined amount in one step, in less than a predetermined period, or in another suitable manner.

Referring to the example of FIG. 3, the cylinder pressure sensor 134 may notify the ECM 130 of the resetting by increasing the cylinder pressure signal 202 to the upper limit and maintaining the cylinder pressure signal 202 at the upper limit for a predetermined period before setting the cylinder pressure signal 202 to the predetermined reset level 204. For example only, the upper limit may be approximately 5.0 V, and the predetermined period may be approximately 20 μs or less. The predetermined period may be calibratable and may be set to less than a period after which the ECM 130 will diagnose the cylinder pressure sensor 134 as being in the open circuit state. Another suitable profile may include, for example only, decreasing the cylinder pressure signal 202 to the lower limit and maintaining the cylinder pressure signal 202 at the lower limit for the predetermined period before setting the cylinder pressure signal 202 to the predetermined reset level 204.

Figure 4:
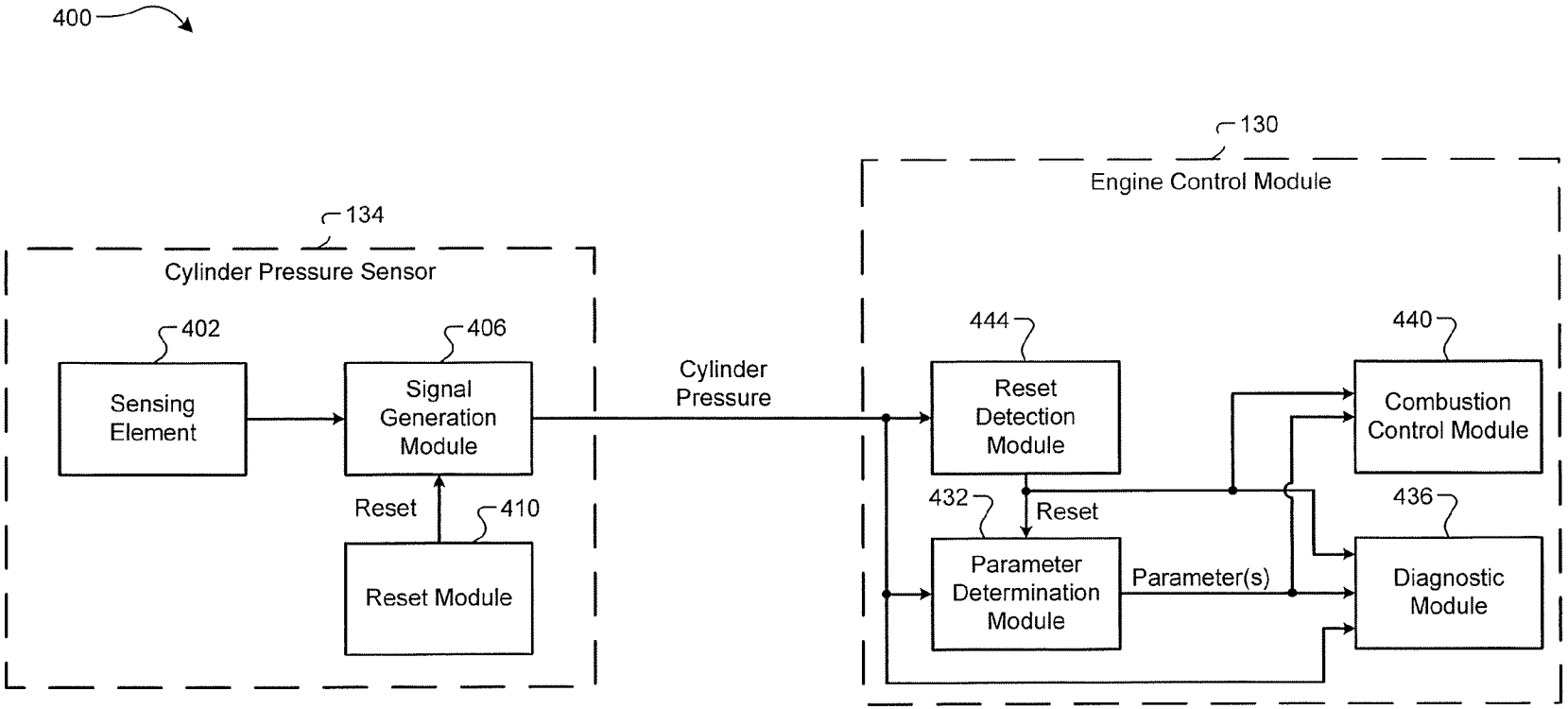
FIG. 4 is a functional block diagram of an exemplary implementation of a cylinder pressure sensor system according to the principles of the present disclosure.

Referring now to FIG. 4, a functional block diagram of an exemplary implementation of a cylinder pressure sensor system 400 is presented. The cylinder pressure sensor 134 may include a sensing element 402, a signal generation module 406, and a reset module 410. The ECM 130 may include a parameter determination module 432, a diagnostic module 436, a combustion control module 440, and a reset detection module 444.

Referring to the cylinder pressure sensor 134, the sensing element 402 may measure the pressure within the cylinder 112. The sensing element 402 may generate a measured pressure signal based on the pressure. The measured pressure signal may include a voltage signal, a current signal, or another suitable type of signal.

The signal generation module 406 generates the cylinder pressure signal based on the measured pressure signal. For example only, the signal generation module 406 may sample the measured pressure signal at a predetermined sampling rate, apply a filter to the samples to determine a reference level, and generate increases in the cylinder pressure signal relative to the reference level. The filtering may be based on a predetermined number of previous samples.

When the reset module 410 generates a reset signal, the signal generation module 406 may generate the predetermined profile in the cylinder pressure signal despite the measured pressure signal. For example only, the signal generation module 406 may increase the cylinder pressure signal to or above the upper limit of the predetermined range and maintain the cylinder pressure signal at or above the upper limit for the predetermined period and then set the cylinder pressure signal to the predetermined reset level when the reset signal is generated. For another example only, the signal generation module 406 may decrease the cylinder pressure signal by at least the predetermined amount and then set the cylinder pressure signal to the predetermined reset level when the reset signal is generated. For another example only, the signal generation module 406 may decrease the cylinder pressure signal to or to less than the lower limit of the predetermined range and maintain the cylinder pressure signal at or below the lower limit for the predetermined period and then set the cylinder pressure signal to the predetermined reset level when the reset signal is generated. The signal generation module 406 generates the predetermined profile in the cylinder pressure signal having a suitable shape such that the ECM 130 can distinguish the predetermined profile from a combustion event.

The reset module 410 selectively generates the reset signal. For example only, the reset module 410 may generate the reset signal when the reset module 410 determines that the reset signal should be generated. The reset module 410 may determine when to generate the reset signal based on one or more parameters, such as a magnitude of the drift. The magnitude of the drift may correspond to a difference between the cylinder pressure signal and one of the limits of the predetermined range. For example only, the reset module 410 may generate the reset signal when the drift is greater than a predetermined drift. In various implementations, the reset module 410 may generate the reset signal after each predetermined period or when one or more other conditions are satisfied.

Referring to the ECM 130, the parameter determination module 432 may determine one or more parameters based on the cylinder pressure signal. For example only, the parameter determination module 432 may determine the cylinder pressure based on the cylinder pressure signal, the pressure ratio, the crankshaft angles at which the predetermined percentages of fuel were combusted within the cylinder 112, respectively, the heat release rate, the IMEP, the cylinder ringing value, the peak pressure experienced, the crankshaft angle where the peak pressure occurred, the knock value, and one or more other suitable parameters. The predetermined percentage may be 10 percent, 50 percent, 90 percent, or another suitable percentage.

The diagnostic module 436 may diagnose one or more faults based on one or more of the determined parameters and/or the cylinder pressure signal. For example only, the diagnostic module 436 may diagnose that the cylinder pressure sensor 134 is in the short circuited state or the open circuited state when the cylinder pressure signal is equal to the lower limit or the upper limit of the predetermined range for a predetermined period, respectively. The diagnostic module 436 may also diagnose one or more other faults based on the cylinder pressure signal and/or one or more of the determined parameters. The diagnostic module 436 may illuminate a malfunction indicator lamp (MIL) when one or more faults are diagnosed.

The combustion control module 440 may control one or more engine operating parameters based on the cylinder pressure signal and/or one or more of the determined parameters. For example only, the combustion control module 440 may control the amount of fuel injected, the timing of the injection of fuel, the spark timing, the opening of the throttle valve 106, and/or other suitable parameters.

When the reset detection module 444 generates the reset signal, the parameter determination module 432, the diagnostic module 436, and the combustion control module 440 may disable use of the cylinder pressure signal and/or the one or more determined parameters. For example only, use of the cylinder pressure signal during the predetermined profile and parameters determined based on the cylinder pressure signal during the predetermined profile may be disabled.

In the case of the parameter determination module 432, for example, the disabling may prevent the parameter determination module 432 from determining one or more of the parameters inaccurately in response to the cylinder pressure signal taking the predetermined profile. The parameter determination module 432 may determine the one or more parameters based on the cylinder pressure signal from before and after the predetermined profile. In this manner, the parameter determination module 432 may take corrective action in determining the one or more parameters instead of being disabled.

In the case of the diagnostic module 436, the disabling may prevent the diagnostic module 436 from incorrectly diagnosing one or more faults in response to the cylinder pressure signal taking the predetermined profile. In the case of the combustion control module 440, the disabling may prevent the combustion control module 440 from unnecessarily adjusting one or more engine operating parameters in response to the cylinder pressure signal taking the predetermined profile.

Figure 5:
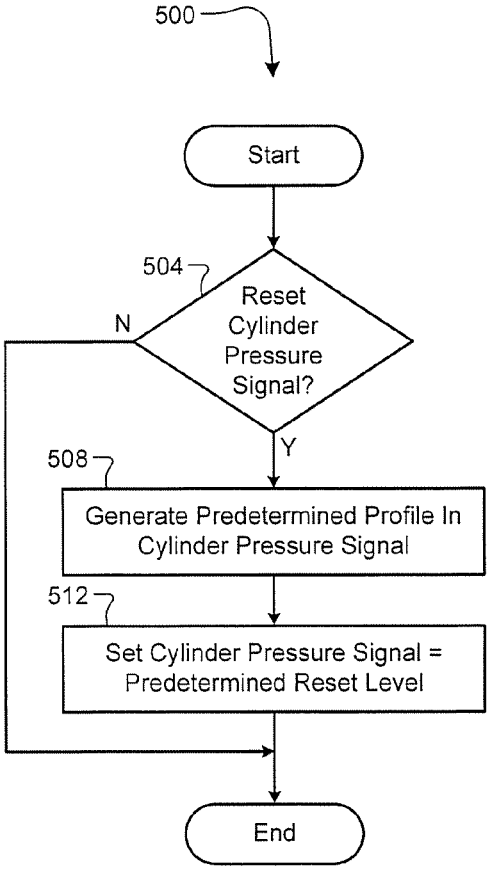
FIG. 5 is a flowchart depicting an exemplary method of generating a predetermined profile in and resetting a cylinder pressure signal according to the principles of the present disclosure.

Referring now to FIG. 5, a flowchart depicting an exemplary method 500 of resetting the cylinder pressure signal is presented. Control may begin with 504 where control determines whether to reset the cylinder pressure signal. If true, control may continue with 508. If false, control may end. For example only, control may determine to reset the cylinder pressure signal when the difference between the cylinder pressure signal and the upper limit is less than the predetermined amount, after each predetermined interval, or when one or more other suitable conditions occur.

Control may generate the predetermined profile in the cylinder pressure signal at 508. Control generates the predetermined profile in the cylinder pressure signal to notify a module receiving the cylinder pressure signal of a resetting of the cylinder pressure signal. For example only, the predetermined profile may include increasing or decreasing the cylinder pressure signal to the upper or lower limit, respectively, and maintaining the cylinder pressure signal at the limit for the predetermined period or decreasing the cylinder pressure signal by at least the predetermined amount.

Control sets the cylinder pressure signal equal to the predetermined reset level at 512. In this manner, control resets the cylinder pressure signal and the reference level to the predetermined reset level. For example only, the predetermined reset level may be approximately 0.7 V. Control may then end.

Figure 6:
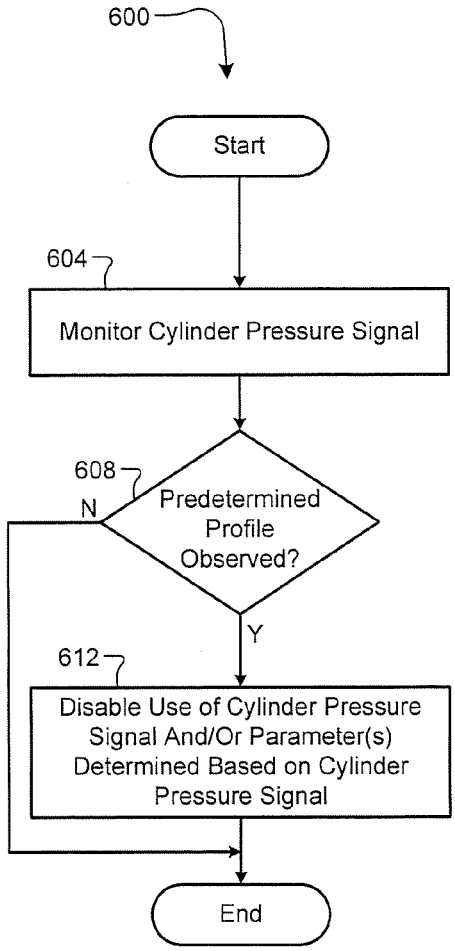
FIG. 6 is a flowchart depicting an exemplary method of detecting resetting of the cylinder pressure sensor according to the principles of the present disclosure.

Referring now to FIG. 6, a flowchart depicting an exemplary method 600 of detecting the resetting of the cylinder pressure signal is presented. Control may begin with 604 where control monitors the cylinder pressure signal. Control may determine whether the cylinder pressure signal has exhibited the predetermined profile at 608. If true, control may continue with 612; if false, control may end.

Control may disable use of the cylinder pressure signal and/or disable use of one or more parameters determined based on the cylinder pressure signal at 612. For example only, control may disable use of the cylinder pressure signal in determining the one or more parameters. Additionally or alternatively, control may disable use of the cylinder pressure signal in diagnosing one or more faults and/or controlling one or more engine operating parameters. Control may then end.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A system for a vehicle, comprising:

a cylinder pressure sensor that measures pressure within a cylinder of an engine, that generates increases in a cylinder pressure signal based on the pressure, that selectively generates a predetermined profile in the cylinder pressure signal, and that selectively resets the cylinder pressure signal to a predetermined reset level after generating the predetermined profile in the cylinder pressure signal; and a control module that receives the cylinder pressure signal, that detects the predetermined profile of the cylinder pressure signal, and that detects the resetting of the cylinder pressure signal to the predetermined reset level when the predetermined profile is detected.

2. The system of claim 1 wherein the control module disables performance of at least one function performed based on the cylinder pressure signal when the resetting is detected.

3. The system of claim 1 wherein the control module selectively diagnoses a fault based on the cylinder pressure signal and disables the selective diagnosis when the resetting is detected.

4. The system of claim 1 wherein the control module selectively determines a parameter based on the cylinder pressure signal and disables the selective determination when the resetting is detected.

5. The system of claim 1 wherein the control module selectively controls an engine operating parameter based on the cylinder pressure signal and disables the selective control when the resetting is detected.

6. The system of claim 1 wherein the cylinder pressure sensor adjusts the cylinder pressure signal to a limit of a predetermined range of the cylinder pressure signal and maintains the cylinder pressure signal outside of the predetermined range for a predetermined period before resetting the cylinder pressure signal to the predetermined reset level, and wherein the control module detects the resetting of the cylinder pressure signal to the predetermined reset level when the cylinder pressure signal is outside of the predetermined range for the predetermined period.

7. The system of claim 1 wherein the cylinder pressure sensor decreases the cylinder pressure signal by at least a predetermined maximum decrease amount, and wherein the control module detects the resetting of the cylinder pressure signal to the predetermined reset level when the cylinder pressure signal decreases by at least the predetermined maximum decrease amount.

8. A cylinder pressure sensor for a vehicle, comprising:

a sensing element that measures pressure within a cylinder of an engine;

a reset module that selectively generates a reset signal; and a signal generation module that generates a cylinder pressure signal based on the pressure, that generates a predetermined profile in the cylinder pressure signal when the reset signal is generated, and that sets the cylinder pressure signal to a predetermined reset level after generating the predetermined profile.

9. The cylinder pressure sensor of claim 8 wherein the cylinder pressure sensor increases the cylinder pressure signal above an upper limit of a predetermined range of the cylinder pressure signal and maintains the cylinder pressure signal above the upper limit for a predetermined period when the reset signal is generated.

10. The cylinder pressure sensor of claim 8 wherein the cylinder pressure sensor decreases the cylinder pressure signal by at least a predetermined maximum decrease amount when the reset signal is generated.

11. The cylinder pressure sensor of claim 8 wherein the cylinder pressure sensor decreases the cylinder pressure signal below a lower limit of a predetermined range of the cylinder pressure signal and maintains the cylinder pressure signal below the lower limit for a predetermined period when the reset signal is generated.

12. A control module for a vehicle, comprising:

a parameter determination module that receives a cylinder pressure signal from a cylinder pressure sensor associated with and measuring pressure within a cylinder of an engine and that selectively determines a parameter based on the cylinder pressure signal; and a reset detection module that detects a reset event of the cylinder pressure signal when the cylinder pressure signal includes a predetermined profile before reaching a predetermined reset level.

13. The control module of claim 12 wherein the reset detection module detects the reset event when the cylinder pressure signal crosses a limit of a predetermined range of the cylinder pressure signal and remains outside of the predetermined range for a predetermined period.

14. The control module of claim 12 wherein the reset detection module detects the reset event when the cylinder pressure signal decreases by at least a predetermined maximum decrease amount.

15. The control module of claim 12 wherein the parameter determination module disables the selective determination when the reset event is detected.

16. The control module of claim 12 further comprising a combustion control module that selectively controls at least one engine operating parameter based on the cylinder pressure signal and that disables the selective control when the reset event is detected.

17. The control module of claim 12 further comprising a diagnostic module that selectively diagnoses a fault based on the cylinder pressure signal and that disables the selective diagnosis when the reset event is detected.

* * * * *